United States Patent [19]

Stone et al.

[11] Patent Number: 4,806,733

[45] Date of Patent: Feb. 21, 1989

[54] RADIANT GLOSSING APPARATUS FOR GLOSSING DEVELOPER SHEETS AND A PROCESS FOR USING THE SAME

[75] Inventors: Benjamin C. Stone, Waynesville; D. Scott Proehl, Miamisburg, both of Ohio

[73] Assignee: The Mead Corporation, Dayton, Ohio

[21] Appl. No.: 16,311

[22] Filed: Feb. 19, 1987

[51] Int. Cl.[4] ..... H05B 3/22

[52] U.S. Cl. ..... 219/216; 355/3 FU; 219/388

[58] Field of Search ..... 219/216, 388, 469, 470, 219/471; 355/3 FU, 14 FU

[56] References Cited

U.S. PATENT DOCUMENTS

| | | | |
|---|---|---|---|
| 3,498,592 | 3/1970 | Moser | 219/216 |
| 3,584,195 | 6/1971 | Vince | 219/216 |
| 3,621,201 | 11/1971 | Crane | 219/469 |
| 3,946,199 | 3/1976 | Nakamura | 219/216 |
| 4,021,641 | 5/1977 | Elter | 219/216 |
| 4,034,189 | 7/1977 | Sakamaki | 219/469 |
| 4,121,888 | 10/1978 | Tomura | 355/3 FU |
| 4,242,566 | 12/1980 | Scribner | 219/216 |
| 4,384,783 | 5/1983 | Sakata | 219/216 |
| 4,518,845 | 5/1985 | Svendsen | 219/469 |
| 4,669,860 | 6/1987 | Elliott | 219/216 |

*Primary Examiner*—Teresa J. Walberg

*Attorney, Agent, or Firm*—Biebel, French & Nauman

[57] ABSTRACT

A radiant glossing apparatus and method for glossing developer sheets having a thermoplastic developer resin on a surface includes a continuous heated support belt for the sheet. The belt carries the sheets under a source of radiant energy in the form of a quartz lamp and reflector which direct the energy downwardly onto the belt-supported sheets. The belt is heated by passing over an arched heated plate. A layer of friction material on the place imparts an electrostatic charge to the belt which assists in holding the sheets against the belt.

5 Claims, 2 Drawing Sheets

RADIANT GLOSSING APPARATUS FOR GLOSSING DEVELOPER SHEETS AND A PROCESS FOR USING THE SAME

BACKGROUND OF THE INVENTION

The present invention relates to a radiant glossing apparatus for glossing developer sheets and a process for using the same.

The developer sheet useful in the present invention can be used in conjunction with conventional pressure-sensitive copy paper or photosensitive imaging systems employing microcapsules to provide visible images upon contact with a color precursor which is image-wise released from the microcapsules and transferred to the developer sheet.

Photosensitive imaging systems employing microencapsulated radiation-sensitive compositions are the subject of commonly assigned U.S. Pat. Nos. 4,399,209 and 4,416,966 as well as copending U.S. patent application Ser. No. 320,643 filed Jan. 18, 1982. These imaging systems are characterized in that an imaging sheet including a layer of microcapsules containing a photosensitive composition in the internal phase is image-wise exposed to actinic radiation. In the most typical embodiments, the photosensitive composition is a photopolymerizable composition including a polyethylenically unsaturated compound and a photoinitiator and is encapsulated with a color precursor. Exposure image-wise hardens the internal phase of the microcapsules.

U.S. Pat. No. 4,399,209 discloses a transfer system in which the imaging sheet is assembled with a developer sheet prior to being subjected to the rupturing force. Upon passing through pressure rollers in contact with the developer sheet, the microcapsules rupture and image-wise release the internal phase whereupon the color precursor migrates to the developer sheet where it reacts with a dry developer and forms a color image. Imaging systems can be designed to produce monochromatic or polychromatic full color images.

In most processes for glossing a developer sheet, heat or a combination of heat and pressure is used to gloss the thermoplastic developer resin. See commonly assigned U.S. Pat. No. 4,554,235. As examples of heat glossing, the developer sheet can be glossed by heating the sheet in contact with a heated roller or a pair of heated rollers. The developer sheet can also be passed over a heated platen or alternatively, the developer sheet can be placed in a hot oven.

Radiant heating sources disposed within reflectors are known for applying heat to a substrate. For example, U.S. Pat. No. 4,021,641 teaches the use of a source of radiant energy within a reflector plus a lens structure for focusing energy onto toner images. The lens is in the form of a belt positioned around the energy source and the reflector. The belt is disposed entirely above the substrate having the toner images such that the energy is focused through the belt onto the toner images.

Known processes for glossing developer sheets suffer from numerous disadvantages. In glossing processes wherein the developer sheet surface having a thermoplastic developer resin thereon contacts a belt which urges the sheet over a heated surface, resin build-up on the belt over a long period of time can occur. In processes involving a belt which transports a substrate beneath a heating element, the belt can act as a heat sink with respect to the heat applied by the heating element. Thus, a need exists in the art for a glossing apparatus for glossing developer sheets and a process for using the same wherein no resin build-up occurs and the transporting means does not act as a heat sink.

SUMMARY OF THE INVENTION

The present invention provides a radiant glossing apparatus for glossing a developer sheet having a thermoplastic developer resin on the surface thereof. Certain thermoplastic resins are capable of forming a film which imparts gloss to the developer sheet upon the application of heat. This film is essentially transparent. The film imparts a gloss finish when the image is formed on an opaque background and transmits light efficiently when the image is formed on a transparent background to provide a transparency.

The apparatus includes a source of radiant energy and reflector means for focusing the radiant energy on a developer sheet to coalesce the thermoplastic developer resin thereon. The source of radiant energy is disposed within the reflector means. Unlike glossing processes where the substrate passes between a belt and the convex surface of a heated plate, the surface of the developer sheet having the thermoplastic resin thereon is not in contact with another surface. Thus, the present apparatus is advantageous because no resin build-up occurs, which could over time adversely affect glossing uniformity. Also, with the present apparatus, no belt clean up is required.

A continuous heated belt, which is disposed entirely beneath the source of radiant energy and reflector means, is provided for transporting the developer sheet under the source of radiant energy and the reflector means. By heating the belt, the belt does not act as a heat sink with respect to the heat applied by the source of radiant energy. Means for driving the belt relative to the source of radiant energy and reflector means is provided.

The present invention also provides a process for glossing a developer sheet having a thermoplastic developer resin on the surface thereof. The thermoplastic developer resin is capable of forming a film which imparts gloss upon the application of heat. The process involves heating a continuous belt. A developer sheet is then fed between the heated belt and a source of radiant energy disposed within a reflector such that the surface of the developer sheet with the thermoplastic developer resin thereon is adjacent to the source of radiant energy. The source of radiant energy is operated at a temperature sufficient to cause the thermoplastic developer resin to coalesce. The belt is disposed entirely beneath the source of radiant energy and the reflector. The belt is driven so as to move the developer sheet relative to the source of radiant energy and reflector. The developer sheet passes from between the belt and the radiant source of energy.

In a preferred embodiment, the step of heating the continuous belt involves driving the belt over the convex side of a heated arched plate. In order to maintain even thermal contact between the developer sheet and the belt, an electrostatic charge is permitted to build into the belt by rubbing contact with an insulating frictional material placed on the convex surface of the arched plate. Even thermal contact is essential, as without it, air pockets can form between the belt and developer sheet. This causes uneven glossing.

Thus, an object of the present invention is to provide a radiant glossing apparatus and process for glossing a developer sheet wherein a belt is used for transporting the developer sheet and is heated so as not to act as a heat sink with respect to the heat applied by the radiant element to the developer sheet.

Another object of the present invention is to provide a radiant glossing apparatus and process wherein the surface of the developer sheet having the thermoplastic resin thereon is not in contact with another surface.

An additional object of the present invention is to provide a means for inducing a charge into the belt to maintain even thermal contact with the developer sheet by electrostatic attraction.

Other objects and advantages of the present invention will become apparent from the following description, the attached drawings and appended claims.

DETAILED DESCRIPTION OF THE INVENTION

Figure 1:
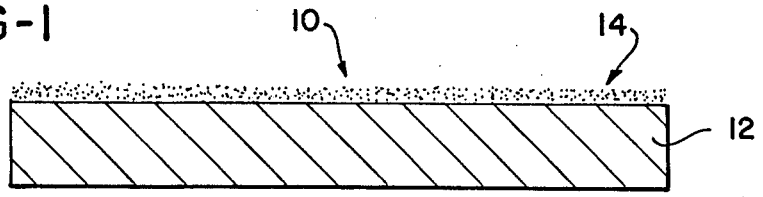
FIG. 1 is a cross-sectional schematic view of a developer sheet useful in the present invention.

A developer sheet useful in the present invention is schematically shown in FIG. 1 wherein the developer sheet is designated generally by the reference 10. The developer sheet 10 includes a support 12 which is overcoated by a layer 14 of a finely divided thermoplastic developer material. Useful materials for the support 12 include both opaque substrates such as paper and transparent substrates such as a polyethylene terephthalate film. However, in a preferred embodiment, the support 12 is paper.

Upon image-wise transfer of a color precursor to the surface of sheet 10, a visible image 16 is formed in layer 14 as shown by the cross-hatching. The visible image 16 is usually the product of an acid-base reaction between the color precursor, which is usually an electron donor, and the developer, which is usually an electron acceptor.

Figure 2:
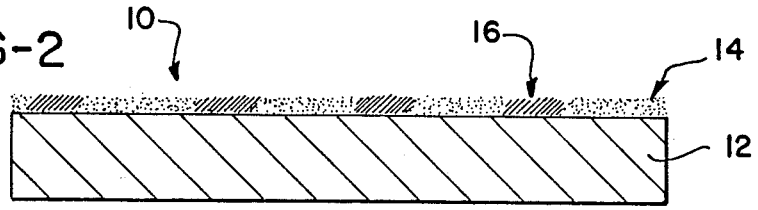
FIG. 2 is a view of the developer sheet of FIG. 1 after image-wise transfer of the color precursor thereto.
Figure 3:
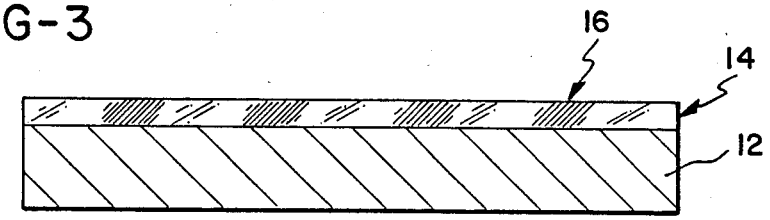
FIG. 3 is a view of the developer sheet of FIG. 2 after coalescing of the thermoplastic developer resin to provide a high gloss finish.
Figure 4:
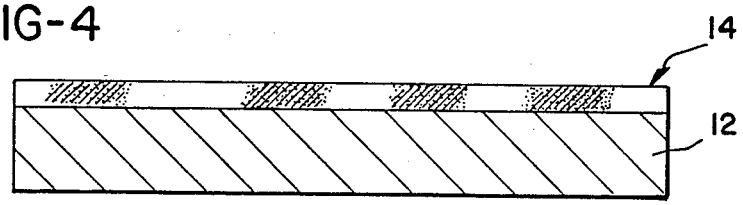
FIG. 4 is a view of the developer sheet of FIG. 2 after coalescing, to provide a matte finish.

After developing the image 16, the developer sheet 10 is subjected to heat using the apparatus of the present invention and according to the process of the present invention to gloss the thermoplastic developer resin on the developer sheet. By varying the process temperatures, degrees of gloss ranging from matte to low to high gloss can be achieved. For example, FIG. 3 schematically illustrates a high gloss finish. The layer 14 is essentially coalesced into a thin continuous translucent film. An intermediate degree of gloss is schematically shown in FIG. 4 in which partial coalescence of the layer 14 gives a finish which is glossier than the uncoalesced intermediate of FIG. 2 but less glossy than the finish of FIG. 3. Where the developer sheet 10 is to be used as a transparency, the support 12 is transparent and complete coalescence of the developer resin is used.

Figure 5:
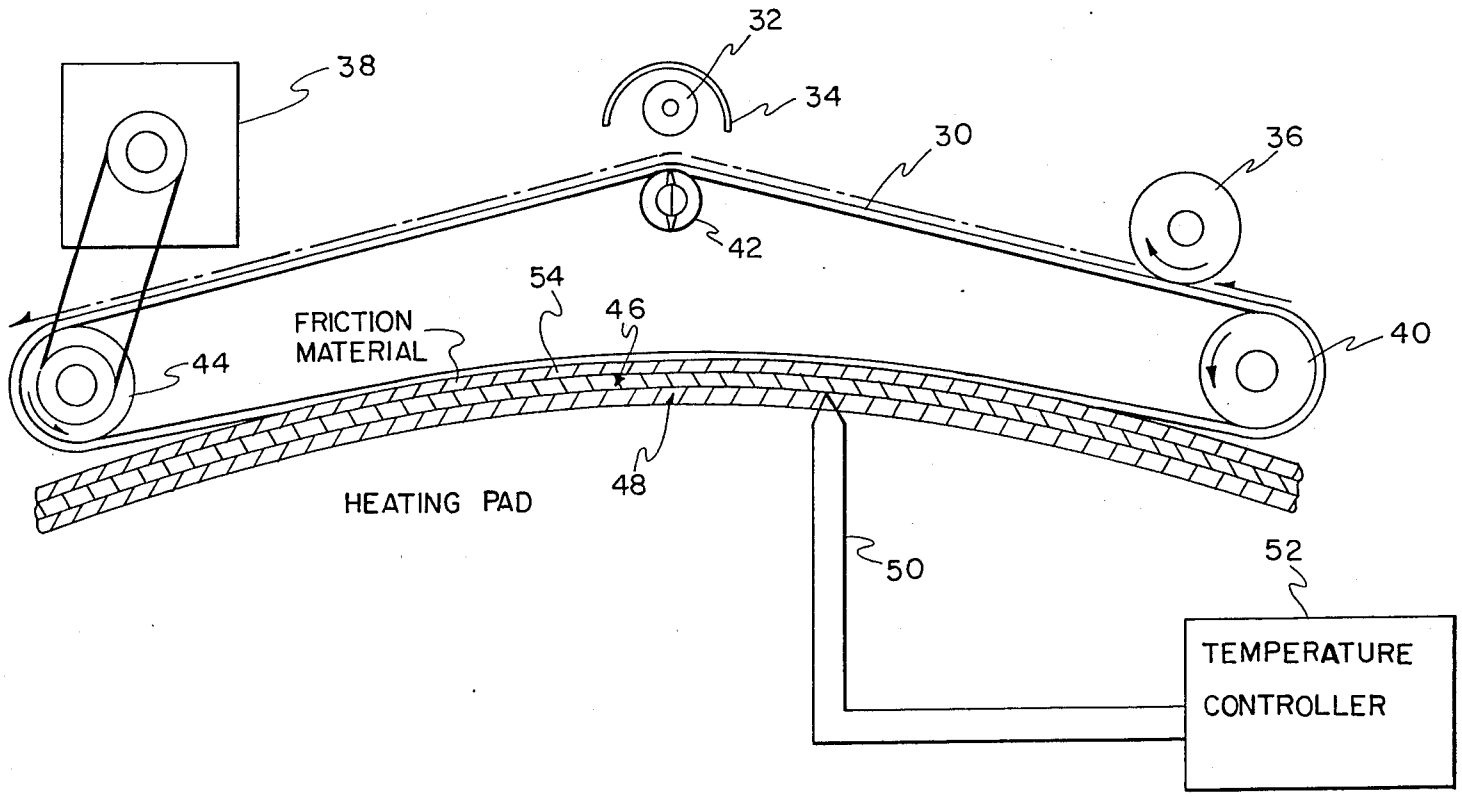
FIG. 5 is a view of an apparatus in accordance with the present invention.

As shown in FIG. 5, the apparatus includes a continuous belt 30. Useful belt materials include silicone rubber, polytetrafluoroethylene and ethylene-propylene diene terpolymer. Silicone rubber is commercially available as black silicone rubber from Textronix, Inc. under part #214-3440. Polytetrafluoroethylene is commercially available from E. I. du Pont DeNemours & Company, while ethylene-propylene diene terpolymer is commercially available from The Goodyear Tire & Rubber Company. In a preferred embodiment, the belt material is silicone rubber. Typically, the thickness of belt 30 is about 0.081 to 0.229 cm (0.032 to 0.090 in) while in a preferred embodiment, the thickness is about 0.102 cm (0.040 in).

The belt 30 is disposed entirely beneath a source of radiant energy 32 and reflector means 34. The distance between the source of radiant energy 32 and the belt 30 is about 0.635 to 0.953 cm (0.250 to 0.375 in), and preferably, about 0.635 cm (0.250 in). The reflector means 34 focuses the radiant energy from source 32 onto a developer sheet 10 to coalesce the thermoplastic developer resin thereon. The source of radiant energy is operated so as to cause the thermoplastic developer resin to coalesce. The source of radiant energy 32 is typically a quartz heating element which operates at a power level of about 300 watts. A quartz heating element from a copy machine can be used in the present invention. Useful quartz heating elements, such as a DAIKEN #312 with 115 volts and 300 watts, are commercially available. As illustrated, the source of radiant energy 32 is disposed within reflector means 34. In a preferred embodiment, reflector means 34 has a width of about 3.81 cm (1.5 in).

The thermoplastic developer resins useful in the present invention typically have softening points ranging from about 100° to 200° C. but those skilled in the art will appreciate that materials with higher and lower softening points may also be used.

Motor 38 drives belt 30 relative to the source of radiant energy 32 and reflector means 34.

Thus, in accordance with the process of the present invention, the continuous belt 30 is heated. Developer sheet 10 is passed between the heated belt 30 and the source of radiant energy 32 disposed within reflector 34 so that the surface of the developer sheet 10 with the thermoplastic developer resin is adjacent to the source of radiant energy 32. The developer sheet 10 is typically fed between belt 30 and entry roller 36 prior to passing under source of radiant energy 32 and reflector means 34. The light pressure exerted by entry roller 36 removes any air between the belt 30 and the developer sheet 10. Afterwards, the electrostatic force between the belt 30 and the developer sheet 10 keeps them in intimate thermal contact. The entry roller 36 is disposed entirely above the belt 30. The belt 30 is then driven so as to transport the developer sheet 10 under the source of radiant energy 32 and reflector 34. The developer sheet 10 passes from between the belt 30 and the radiant source of energy 32. As mentioned earlier, the present apparatus and process are advantageous because the surface of the developer sheet having the thermoplastic developer resin thereon is not in contact with another surface during the process, and thus, the resulting film on the developer sheet is more uniform.

In a preferred embodiment, the apparatus additionally includes roller means around which belt 30 is placed. As illustrated in FIG. 5, belt 30 is placed around idler roller 40, tensioning roller 42 and drive roller 44.

Various means of heating the continuous belt 30 can be used. In a preferred embodiment, the apparatus includes a heated arched plate 46 which is situated entirely beneath belt 30 and adapted to engage the belt on the convex side thereof. The belt 30 is held snugly against the convex surface of heated arched plate 46 and is heated by the plate. As a preferred method of heating belt 30, the belt 30 is driven over the convex side of heated arched plate 46. Typically, arched plate 46 is heated to a temperature of about 150° C. Typically, arched plate 46 has a thickness of about 0.081 to 0.229 cm (0.032 to 0.090 in). In a preferred embodiment, the thickness is about 0.081 cm (0.032 in). Useful arched plate materials include stainless steel and aluminum but in a preferred embodiment, the arched plate material is stainless steel. Typically, the radius of arched plate 46 is about 56 cm (22 in).

Various means can be used for heating arched plate 46. In a preferred embodiment, the apparatus includes a heating pad 48 which is situated beneath arched plate 46. Thus, unlike other methods where a surface is heated by applying heat at one point and allowing heat transfer throughout the surface, the use of heating pad 48 permits uniform heating of arched plate 46. A useful heating pad is commercially available from Electro-Flex Heat, Inc. The power required per unit area is about 0.775 to 1.55 watts/cm$^2$ (5 to 10 watts/in$^2$). Thermocouple 50 monitors the temperature which is controlled by temperature controller 52.

Typically, developer sheet 10 contacts belt 30 for about 25.4 cm (10 in). Typically, the speed of belt 30 is about 254 cm/min (100 in/min). The main consideration in setting the process variables is assuring that the thermoplastic developer resin forms a film which imparts gloss to developer sheet 10.

In order to maintain even thermal contact between the belt 30 and developer sheet 10, electrostatic attraction is used. A charge is induced into the belt 30 by placing an insulating frictional material 54 on the convex surface of arched plate 46. The rubbing action of the belt on the fictional material produces the static change. Paper and glass fabric are examples of useful insulating frictional materials.

Thus, the present apparatus and process are advantageous because the surface of the developer sheet having the thermoplastic resin thereon is not in contact with another surface, the belt is heated so as to not act as a heat sink and even thermal contact is maintained between the developer sheet and belt by electrostatic attraction.

Having described the invention in detail and by reference to preferred embodiments thereof, it will be apparent that modifications and variations are possible without departing from the scope of the invention defined in the appended claims.

What is claimed is:

1. A radiant glossing apparatus for glossing a developer sheet having a thermoplastic developer resin on the surface thereof, said thermoplastic developer resin being capable of forming a film which imparts gloss upon the application of heat, comprising:

a source of radiant energy;

reflector means for focusing said radiant energy directly on said developer sheet to soften said thermoplastic developer resin, said source of radiant energy being disposed within said reflector means;

a continuous heated belt for transporting said developer sheet under said source of radiant energy and said reflector means, said belt being disposed entirely beneath said source of radiant energy and said reflector means;

roller means around which said belt is placed;

means for driving said belt relative to said source of radiant energy and said reflector means;

a heated arched plate situated entirely beneath said belt and adapted to engage on the convex side thereof said belt, said belt being held snugly against said convex surface of said plate and being heated by said plate; and insulating frictional material on said convex surface of said arched plate such that a charge is induced in said belt so that even thermal contact by electrostatic attraction is maintained between said developer sheet and said belt.

2. The apparatus of claim 1 wherein said belt is silicone rubber.

3. The apparatus of claim 2 wherein said apparatus additionally comprises a heating pad situated beneath said arched plate to heat it.

4. The apparatus of claim 3 wherein said apparatus additionally comprises an entry roller situated upstream of said source of radiant energy and said reflector means, said entry roller being disposed above said belt.

5. The apparatus of claim 1 wherein said arched plate is a thin gauged stainless steel.

* * * * *